US007999471B2

(12) United States Patent
Jacobsen et al.

(10) Patent No.: US 7,999,471 B2
(45) Date of Patent: Aug. 16, 2011

(54) MULTI-CELL ELECTRONIC CIRCUIT ARRAY AND METHOD OF MANUFACTURING

(75) Inventors: Stephen C. Jacobsen, Salt Lake City, UT (US); Fraser M. Smith, Salt Lake City, UT (US); Shayne M. Zurn, Salt Lake City, UT (US); Marc Olivier, Sandy, UT (US)

(73) Assignee: Raytheon Company, Waltham, MA (US)

( * ) Notice: Subject to any disclaimer, the term of this patent is extended or adjusted under 35 U.S.C. 154(b) by 1266 days.

(21) Appl. No.: 11/637,379

(22) Filed: Dec. 11, 2006

(65) Prior Publication Data

US 2007/0132392 A1 Jun. 14, 2007

Related U.S. Application Data

(60) Provisional application No. 60/749,779, filed on Dec. 12, 2005.

(51) Int. Cl.
*H01J 17/49* (2006.01)

(52) U.S. Cl. ..... 313/582; 313/583; 445/24

(58) Field of Classification Search ..... 313/582–587, 313/495, 483–485, 493, 634; 445/23–25
See application file for complete search history.

(56) References Cited

U.S. PATENT DOCUMENTS

| | | | | |
|---|---|---|---|---|
| 3,938,135 | A | 2/1976 | DeJule et al. | |
| 3,947,722 | A | 3/1976 | Strom et al. | |
| 3,969,650 | A | 7/1976 | Chodil et al. | |
| 4,027,188 | A | 5/1977 | Bergman | |
| 4,227,236 | A | 10/1980 | Kuebler | |
| 5,270,485 | A | 12/1993 | Jacobsen et al. | |
| 5,583,432 | A * | 12/1996 | Barnes | 324/204 |
| 5,767,824 | A * | 6/1998 | Jacobsen | 345/55 |
| 5,984,747 | A | 11/1999 | Bhagavatula et al. | |
| 6,414,433 | B1 | 7/2002 | Moore | |
| 6,576,406 | B1 | 6/2003 | Jacobsen et al. | |
| 6,677,704 | B2 | 1/2004 | Ishimoto et al. | |
| 6,836,063 | B2 | 12/2004 | Ishimoto et al. | |
| 6,930,442 | B2 | 8/2005 | Awamoto et al. | |
| 2005/0088091 | A1 * | 4/2005 | Tokai et al. | 313/582 |
| 2007/0052621 | A1 * | 3/2007 | Hirakawa et al. | 345/60 |

FOREIGN PATENT DOCUMENTS

WO WO00/65629 11/2000

OTHER PUBLICATIONS

European Search Report, Publication No. 1969612, Sep. 17, 2008.

* cited by examiner

*Primary Examiner* — Bumsuk Won
*Assistant Examiner* — Kevin Quarterman
(74) *Attorney, Agent, or Firm* — Thorpe North & Western LLP

(57) ABSTRACT

A method for fabricating a multi-cell electronic circuit array and exemplary multi-cell electronic circuit arrays are disclosed. In one embodiment, a multi-cell electronic circuit array includes an elongate substrate having a linear array of first electronic cell components micro fabricated thereon. The elongate substrate is inserted into a tubular enclosure which has at least one second electronic cell component which interacts with the first electronic cell components.

31 Claims, 6 Drawing Sheets

MULTI-CELL ELECTRONIC CIRCUIT ARRAY AND METHOD OF MANUFACTURING

This application claims the benefit of U.S. Provisional Patent Application Ser. No. 60/749,779 filed on Dec. 12, 2005, entitled "Multi-cell Electronic Circuit Array and Method of Manufacturing" which is herein incorporated by reference.

BACKGROUND OF THE INVENTION AND RELATED ART

Various types of electronic devices require an array of electronic cells. For example, plasma displays require a two-dimensional array of display cells. The individual display cells of a plasma display each include a number of electronic components which cooperate to provide an individually addressable pixel. In a plasma cell, a combination of electrodes excites a gas into a plasma state where the plasma radiates at ultraviolet wavelengths. The ultraviolet emissions are converted by a phosphor into visible light, for example, using phosphors which emit red, green, or blue light. Components of a plasma cell can include electrodes, dielectric regions, gas enclosures, and phosphors. Plasma displays are often fabricated on a pair of flat substrates. A first, rear substrate is processed to create geometric features of the array of display cells, for example, to define individual plasma regions for each cell. The geometric features can be formed by sand blasting or etching. Various electronic components are formed on the first substrate, such as electrodes and dielectrics using lithographic and other techniques. A second, front substrate is typically bonded to the first substrate to create chambers which can enclose a gas in which a plasma can be formed. Components, such as electrodes and phosphors may also be disposed on the second substrate. Unfortunately, processing large substrates in this manner has proven difficult and expensive. Although advancements in the manufacturability and cost of large plasma displays using flat substrate construction have been achieved, these displays are still difficult to make. Furthermore, there is a desire to manufacture very large displays, and existing techniques do not scale up well to larger sizes.

An alternate approach to manufacturing plasma displays has been to use fiber technology. Long tubes can be drawn from glass and filled with gas. Electrodes can be deposited on the outside or threaded inside the tubes. Unfortunately, manufacturing displays using this approach has also proven difficult. For example, using this construction approach, the geometric configuration of the display cell is relatively limited. Consequently, optimizing the placement and arrangement of display cell components is difficult to achieve. For example, it is difficult to ensure that primary radiation emitted by the plasma discharge is efficiently coupled into the secondary emission region, since most of the components are placed on the outside of the tube. Since one of the electrodes is generally outside the tube, it is difficult to find a placement which provides good coupling to the primary emitting region. Additionally, non-uniformity in tube dimensions and relative position of electrodes and tubes can result in large variation in operational parameters such as drive voltage and firing voltage from tube to tube. Tubular displays have thus been somewhat limited in various performance aspects in comparison to substrate based displays.

More generally, techniques for fabrication of arrays of electronic components are generally limited. Many electronic devices are fabricated using semiconductor processing techniques on planar crystalline wafers. These wafers are fragile and require special packaging and handling of the completed devices. Semiconductor processing techniques do not scale well to large dimensions, for example as desired for plasma displays.

SUMMARY OF THE INVENTION

The present invention includes multi-cell electronic circuit array devices and fabrication techniques which help to overcome problems and deficiencies inherent in the prior art.

Generally, the present invention describes multi-cell electronic circuit arrays and techniques for their manufacture. In accordance with the invention as embodied and broadly described herein, the present invention features a multi-cell electronic circuit array. The multi-cell electronic circuit array includes an elongate substrate having a linear array of first electronic cell components microfabricated thereon. The linear array of first electronic cell components is inserted into a tubular enclosure which has at least one second electronic cell component to interact with the linear array of first electronic cell components. Because structures and circuitry can be microfabricated on the linear array and then placed into the tubular enclosure, many degrees of freedom are obtained in the design of a multi-cell electronic circuit array.

The present invention further features a plasma display. The plasma display includes a plurality of parallel gas enclosure tubes, which contain linear arrays of plasma cell components inserted therein.

The present invention still further features a method for fabricating a multi-cell electronic circuit array.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, can be arranged and designed in a wide variety of different configurations. Nonetheless, the invention will be described and explained with additional specificity and detail through the use of the accompanying drawings in which:

DETAILED DESCRIPTION OF EXEMPLARY EMBODIMENTS

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

Figure 1:
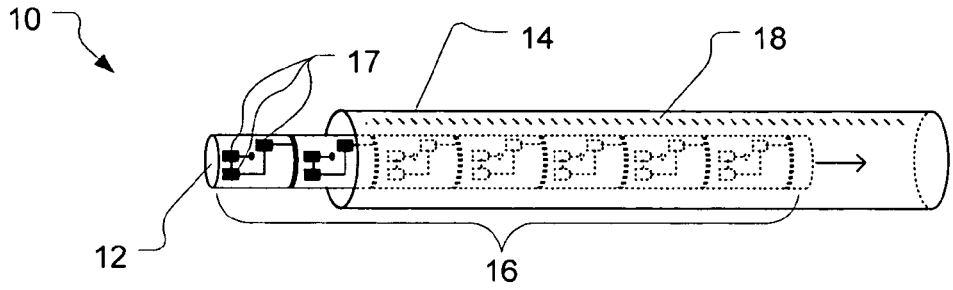
FIG. 1 illustrates a side perspective view of multi-cell electronic circuit array according to an embodiment of the present invention.

With reference to FIG. 1, shown is an illustration of a multi-cell electronic circuit array according to a first exemplary embodiment of the present invention. Specifically, FIG. 1 illustrates the multi-cell electronic circuit array 10 as including an elongate substrate 12 and a tubular enclosure 14. The elongate substrate has a linear array 16 of first electronic cell components 17 microfabricated thereon. The elongate substrate can, for example, be a long rod of circular, elliptical, triangular, square, rectangular, octagonal, polygonal, or even variable cross section before the fabrication of the first electronic cell components thereon. For example, suitable elongate substrates can be formed from fibers such as drawn glass. As another example, elongate substrates can be quite small in diameter, for example 0.5 mm (500 micron), or 100 microns, or even 50 micron in diameter. Conversely, elongate substrates can be relatively large, for example 5 mm or 10 mm in diameter.

The elongate substrate 12 is inserted into the tubular enclosure 14. The elongate substrate is shown partially inserted in FIG. 1 for clarity of illustration; in general the elongate substrate can be partially or completely enclosed by the tubular enclosure. The tubular enclosure may be closed on the ends after insertion of the elongate substrate. The tubular enclosure is in the form of a hollow rod, and can also have a circular, elliptical, triangular, square, rectangular, octagonal, polygonal, or even variable cross section. Moreover, the interior and exterior cross section can be different from each other. That is to say, the shape of the interior hollow bore of the tubular enclosure can be different from the exterior shape of the tubular enclosure.

The tubular enclosure 14 has at least one second electronic cell component 18 which interacts with the first electronic cell components 17 to form an array of electronic circuits. For example, the tubular enclosure can include a plurality of second electronic cell components microfabricated thereon. Each second electronic cell component can interact and cooperate with a corresponding first electronic cell component. Various types of electronic cell components, including semiconductor devices, electrical interconnect, phosphors, and the like can be included.

Various first electronic cell components 17 can be fabricated on the elongate substrate 12. For example, electronic circuits can be microfabricated as discussed in further detail below. As another example, electronic circuits can also be microfabricated on the outer surface of the tubular enclosure to provide one or more second electronic cell components 18. As yet another example, electronic interconnect elements can be fabricated on the elongate substrate and outer surface of the tubular enclosure.

Electronic circuitry on the elongate substrate can cooperate with the second cell component(s) on the tubular enclosure to form detector or emitter circuits. For example, a microvacuum tube can be created for operation in the THz region, such as a klystron. As additional examples, Geiger tubes, electron or ion amplifiers, electro-optic detectors, photomultiplier tubes, charge coupled devices, image converters, and image intensifiers can be fabricated for operation at various wavelengths. As further examples, gas discharge light sources, spark discharge light sources, vacuum fluorescent light emitting elements, and gas to ion lasers can also be created. Fluidic control devices, using effects such as electro wetting of fluid on dielectric, can also be fabricated.

Because the linear array of first electronic cell components are microfabricated on the elongate substrate, detailed electronic circuits can be placed into the tubular enclosure. For example, the first electronic cell components can be highly integrated, providing high circuit density. By placing the electronic components within the tubular enclosure, various advantages can be obtained. For example, by immersing components of a detector or emitter in a gas or liquid contained within the tubular enclosure, lead lengths can be shortened and other effects achieved. A gas or gas mixture within the tubular enclosure can be optimized for particular applications (e.g. plasma display or fluorescent lighting).

Figure 2:
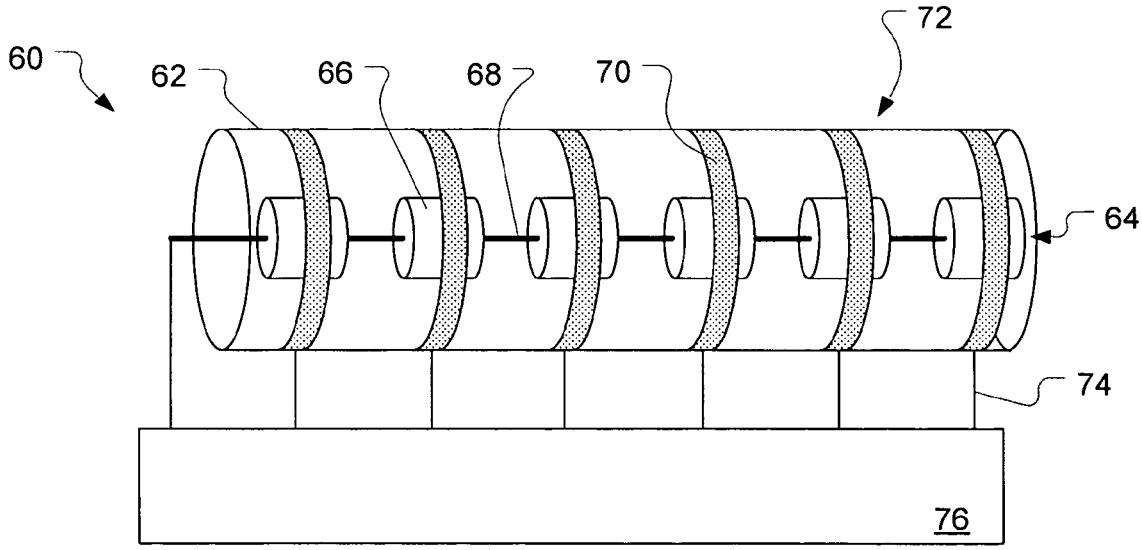
FIG. 2 illustrates a side perspective view of a capacitive touch sensor according to an embodiment of the present invention.

A first detailed example of a multi-element electronic circuit array will now be described in accordance with an embodiment of the present invention. FIG. 2 illustrates a capacitive touch sensor in accordance with an embodiment of the present invention. The capacitive touch sensor, shown generally at 60, includes a tubular enclosure 62, into which an elongate substrate 64 has been inserted. The elongate substrate includes a linear array of first capacitor electrodes 66, electrically connected together by a first electrical conductor 68. Although the first capacitor electrodes are shown here in the form a cylinder, various other geometric structures can be used as well. The tubular enclosure includes a linear array of second capacitor electrodes 70. Corresponding pairs of first capacitor electrodes and second capacitor electrodes are placed adjacent to each other, so that the capacitive touch sensor includes a plurality of capacitors 72. A plurality of second electrical conductors 74 can be included, each of which electrically connects one of the second capacitor electrodes to an electronic circuit 76 which can measure capacitance.

The electrical capacitance of each capacitor 72 will depend on the size of the electrodes 66, 70 and the electrical properties of the tubular enclosure 62, elongate substrate 64, and surrounding environment. When an object, such as a finger, is placed in proximity to a pair of electrodes, this will cause the capacitance of the corresponding capacitor to change by an amount dependent upon the electrical properties of the object. Accordingly, the position of the object can be sensed based on which pair (or pairs) of electrodes show a changed capacitance as measured by the electronic circuit 74. Various electronic circuits for measuring capacitance are known in the art and will not be discussed further.

For example, a one-dimensional position sensing array can determine the position along the length of the capacitive touch sensor 60 by measuring capacitance between the first electrical conductor 68 and each of the plurality of second electrical conductors 72. The position of the touch can be determined from which one or more of the capacitors 70 have changed value.

As another example, a two-dimensional position sensing array can be constructed using a number of parallel capacitive touch sensors 60. The first electrical conductors 68 can be used as rows. Columns of second electrodes 70 can be connected in series though shared second electrical conductors 74 across the parallel tubular enclosures to form columns to provide row-column addressing. The position of a touch can thus be determined from the row-column pair (or pairs) which exhibit a changed capacitance.

Figure 3A:
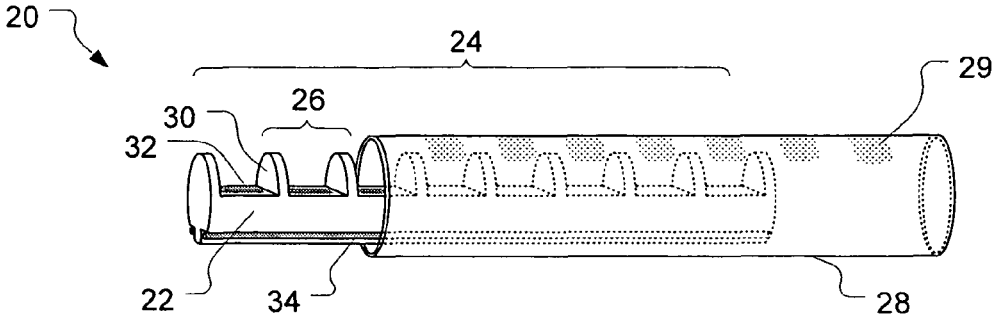
FIG. 3*a* illustrates a side perspective view of a plasma display tube according to another embodiment of the present invention.

As another example, a multi-cell electronic circuit array can be a plasma display tube as will now be described in accordance with an embodiment of the present invention. FIG. 3*a* illustrates a plasma display tube, shown generally at 20. The plasma display tube includes an elongate substrate 22 having a linear array 24 of first plasma cell portions 26. The elongate substrate is contained within a tubular enclosure 28. The tubular enclosure can be sealed at the ends (not shown) to enclose a gas. For example, the tube can include an inert gas, such as Helium, Neon, or Xenon, similar gases, or combinations thereof which can be excited to form a plasma. The tubular enclosure includes a linear array of second plasma cell portions 29. The second plasma cell portions can, for example, include a secondary emission region 36 and an electrode 38. The secondary emission region can, for example, include a phosphor for conversion of ultraviolet radiation emitted from the primary emission region into visible light. The electrode can, for example, include a transparent electrode.

Figure 3B:
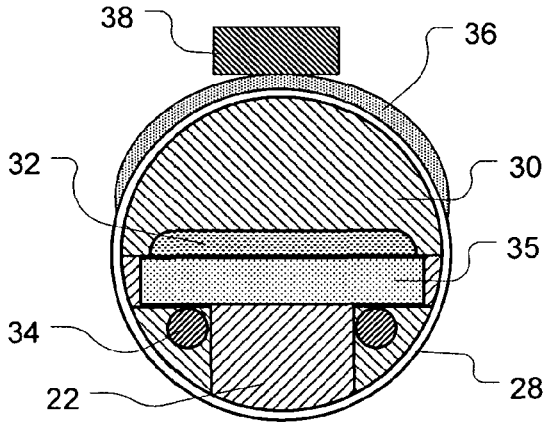
FIG. 3*b* illustrates an end cross-sectional view of a plasma display cell of FIG. 3.
Figure 3C:
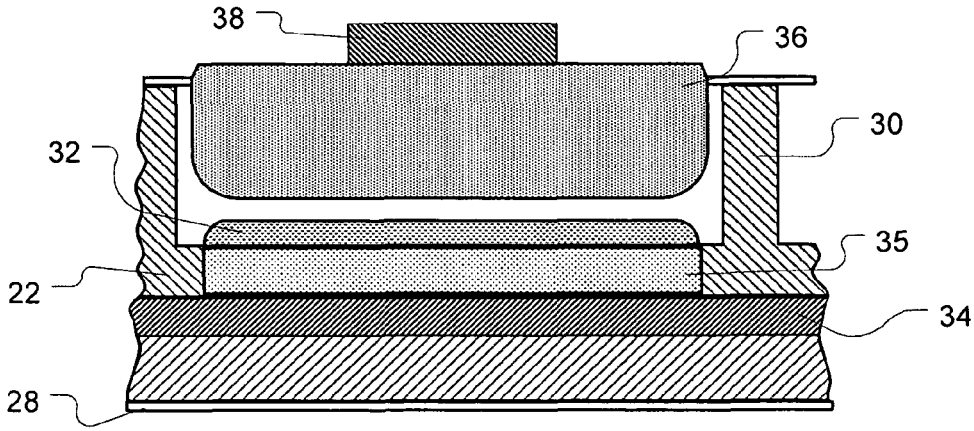
FIG. 3*c* illustrates a side cross-sectional view of the plasma display cell of FIG. 3.

The plasma cell of FIG. 3*a* is shown in further detail, in side view FIG. 3*b* and cross-sectional view FIG. 3*c*. The elongate substrate 22 can be a dielectric such as glass. The plasma cell includes a cell separating structure 30. The cell separating structures provide a barrier between adjacent cells to help isolate plasma emissions from leaking into adjacent cells. Accordingly, the inclusion of the cell separating structures helps to provide increased resolution in a display using the disclosed plasma display cells. Fabrication of cell separating structures have previously proven difficult to achieve in previous display construction techniques using fiber technology, and accordingly, such displays have provided less resolution than desired.

The display cell also includes a primary emission region 32. For example, the primary emission region can include MgO to help enhance ultraviolet discharge emission from the plasma and allow reduced operating voltage. Electrodes 34 are disposed longitudinally along the elongate substrate 22, beneath the primary emission region. The electrodes can be placed close to the primary emission region, helping to enhance efficiency over prior art display cells.

A dielectric material 35 may be disposed between the electrodes 34 and the primary emission region 32 to enhance the coupling between the electrodes and the primary emission region. The electrodes are used to stimulate surface charge in the primary emission region which in turn stimulates the gas to form a plasma discharge. Various techniques for applying voltages to the electrodes to initiate, sustain, and terminate plasma discharge are known in the art which can be applied in the context of the present invention.

In general, microfabricating the cell components on an insertable substrate helps to avoid problems with previous attempts to insert coatings or elements into the interior of a display tube. Because the cell components can be precisely positioned on the insertable substrate, the geometry of the plasma display cell can be optimized to provide increased efficiency. Inclusion of components, such as specific electrode shapes, dielectric regions, and secondary emission materials is made possible, providing a large degree of design freedom to design the plasma display cell for desired properties.

Continuing the discussion of the plasma display cell, disposed on the tubular enclosure 28 is a secondary emission region 36. Alternately, the secondary emission region can be disposed on the inside of the tubular enclosure as is discussed further below. The secondary emission region can include a phosphor, which converts the ultraviolet emission into visible light, and is thus placed opposite the primary emission region. Quartz, fused silica, certain polymers, or other ultraviolet transparent materials can be used for the tubular enclosure. A protective coating may also be included over the secondary emission region to help protect the phosphor from exposure to the environment.

Note that the geometry of the cell defined by the substrate 22 can be configured to place the primary emission region in relatively close proximity to the secondary emission region. This helps to ensure that the primary emission is absorbed and converted by secondary emission region, rather than being absorbed by the cell separating structure 30 or other parts of the display cell. Accordingly, the efficiency of the display cell is increased.

Various phosphors are known which convert ultraviolet into red, green, and blue visible light. The plasma display tube 20 can be constructed with all of the plasma cells having the same color phosphor, for example, by applying a strip of phosphor along one side of the tubular enclosure. Alternately, the plasma display tube can be constructed with different color phosphors by microfabricating a linear array of discrete phosphor regions, selecting alternate colors for each successive cell. The tubular enclosure can also include an electrode 38. For example, display cell addressing can be performed using the combination of the electrodes 34, 38 as discussed for a plasma display below.

Figure 4A:
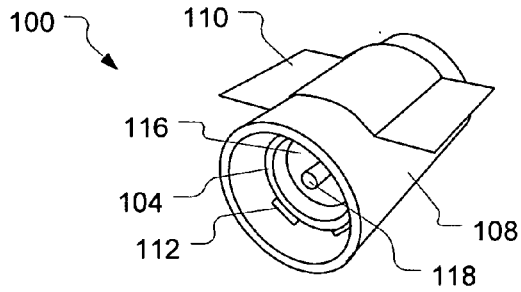
FIG. 4*a* illustrates an end-on perspective view of an alternate arrangement of a plasma display tube according to an embodiment of the present invention.
Figure 4B:
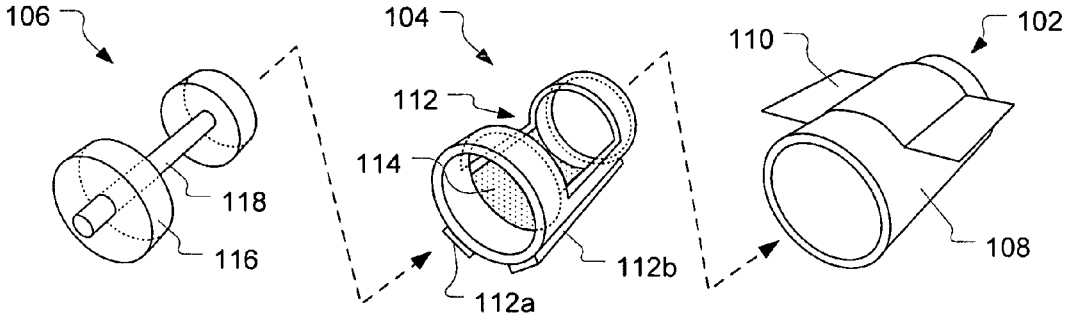
FIG. 4*b* illustrates an end-on exploded perspective view of the plasma display tube of FIG. 4*a;*

An alternate embodiment of a plasma display tube is illustrated in perspective view in FIGS. 4*a* and 4*b* in accordance with an embodiment of the present invention. FIG. 4*a* provides an end-on perspective view of the plasma tube 100 in an assembled configuration, and FIG. 4*b* shows an exploded view of the plasma tube, showing three sub-assemblies, an enclosure subassembly 102, first substrate 104, and second substrate 106. The enclosure subassembly includes a tubular enclosure 108 and an electrode 110 disposed on the outer surface of the tubular enclosure. The electrode can be used as an addressing electrode. The tubular enclosure can be formed of various materials, including for example, an extruded tube formed of glass or polymer material. The electrode can be formed of a transparent conductor, including for example, Indium Tin Oxide.

The first substrate 104 is inserted into the enclosure sub-assembly 102. The first substrate is a hollow tube, for example, in the form of a glass tube. Disposed along the outer side are two coplanar electrodes 112*a*, 112*b*. The tube includes a cutout section 114 to expose an inner wall of the tube. Disposed on the inner wall of the tube is a dielectric region 116, for example, Magnesium Oxide. The coplanar electrodes and dielectric region can be formed, for example, by cylindrical lithography.

The second substrate 106 is inserted into the first substrate 104. The second substrate includes cell separating structure 116 and a phosphor rod 118. The cell separating structure helps to define the plasma cell boundary, confining the plasma within the region defined by the cell separating structure and the inner surface of the tubular enclosure 108. The plasma display tube 100 can include a gas disposed within the tube, filling the region, for example as described above. The ends can be sealed, for example, using a cap or plug.

The plasma display tube 100 functions similarly as described above. Surface charge is created on the dielectric region 116 by the coplanar electrodes 112, which in turn excites the gas to form a plasma. Addressing of individual cells within the plasma display tube can use the combination of electrodes 110, 112*a*, 112*b*. The plasma emits ultra violet light, which is converted by the phosphor 118 into visible light, which can radiate out of the plasma cell.

The cell separating structure 116 can be an ultraviolet-opaque material, which helps to confine the ultraviolet radiating to the inside of the cell, reducing leakage into adjacent cells. Furthermore, the phosphor 118 is placed in close proximity to the dielectric region 114, helping to improve the efficiency of conversion of ultra-violet light into visible light.

Figure 5:
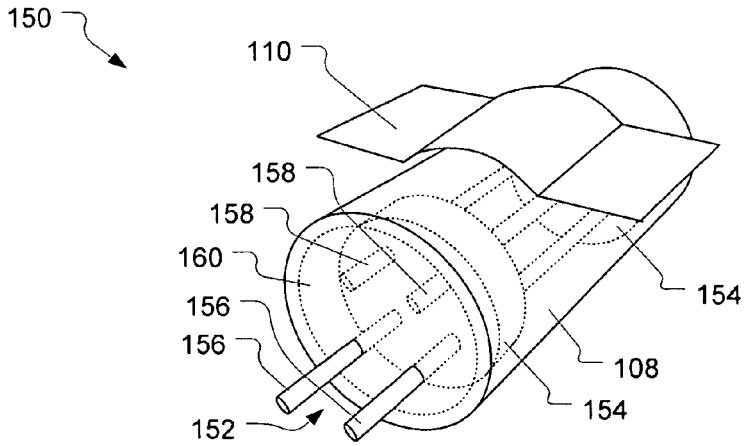
FIG. 5 illustrates an end-on perspective view of another alternate arrangement of a plasma display tube according to an embodiment of the present invention.

FIG. 5 illustrates another arrangement of a plasma display tube, in accordance with an alternate embodiment of the present invention. The plasma display tube, shown generally at 150, includes a tubular enclosure 108 with an electrode 110, similarly to the embodiments described above. A substrate 152 is inserted into the tubular enclosure. The substrate includes a plurality of cell separating structures 154 through which four rods are inserted. The four rods include two electrode rods 156 and two phosphor rods 158. The end of the tubular enclosure is hermetically sealed with a cap 160, for example by using a glass frit. The electrode rods extend through the cap, allowing electrical connection to be made thereto. The electrode rods can be coated with a dielectric material, such as Magnesium Oxide. Operation of the plasma display tube 150 is similar to previously described embodiments.

One benefit of the plasma display tube 150 as just described is that the electrode rods 156 can be placed very close to the phosphor rods 158, providing efficient conversion of ultraviolet light into visible light.

Figure 6:
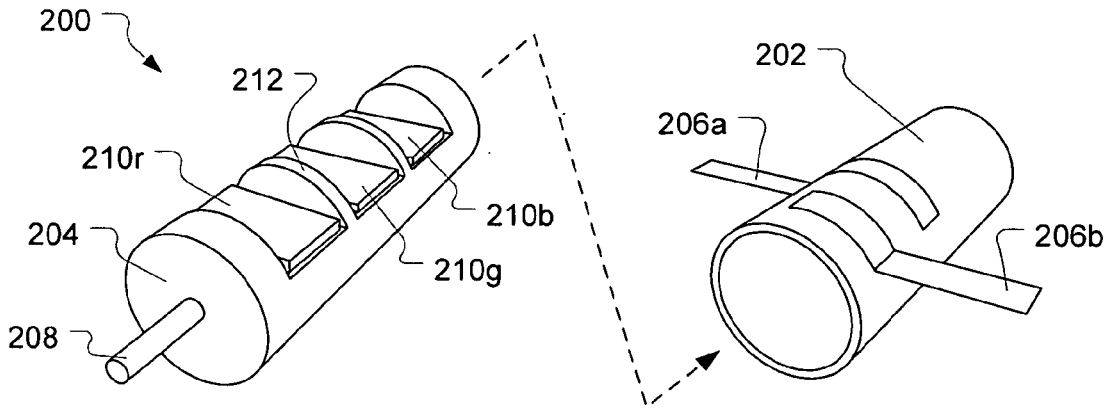
FIG. 6 illustrates an exploded end-on perspective view of an alternate arrangement of a plasma display tube according to an embodiment of the present invention.

FIG. 6 illustrates an exploded end-on perspective view of an alternate arrangement of a plasma display tube. The plasma display tube, shown generally at 200, includes a tubular enclosure 202 and an elongate substrate 204. The tubular enclosure includes electrodes 206*a*, 206*b*, for example, of Indium Tin Oxide. The elongate substrate includes an electrode 208, for example, of Stainless Steel wire. Hollowed out regions of the elongate substrate have phosphor 210 disposed within, for example sections of red phosphor 210*r*, green phosphor 210*g*, and blue phosphor 210*b*, to create alternating plasma cells of red, green, and blue color. As described above, the elongate substrate is hollowed out so that cell separating structures 212 are defined between the cells. As alternate arrangement, the exterior electrodes can be omitted and two or more interior electrodes included.

Figure 7:
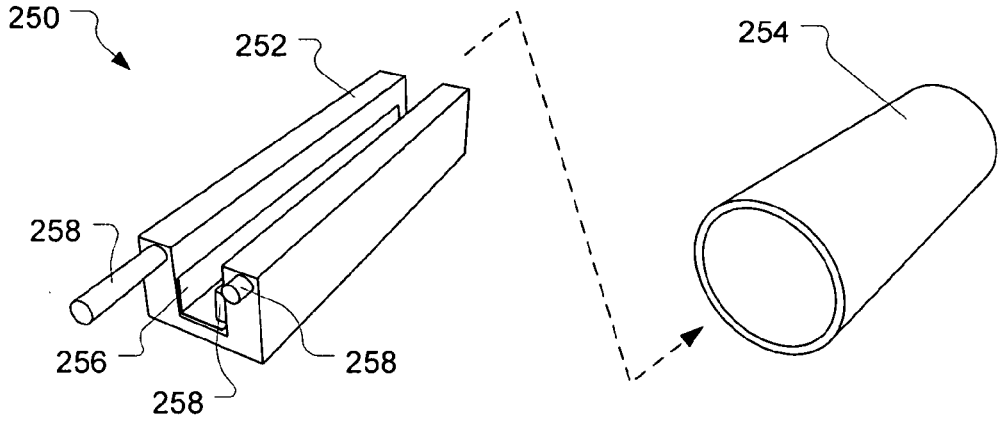
FIG. 7 illustrates an exploded end-on perspective view of another arrangement of plasma display tube according to an embodiment of the present invention.

FIG. 7 illustrates an exploded end-on perspective view of another arrangement of plasma display tube 250. As before, an elongate substrate 252 is disposed within a tubular enclosure 254. The elongate substrate is a micromachined square rod, having a trench disposed down the center in which a dielectric 256 and a phosphor 258 are deposited. Electrodes 258 are disposed within the elongate substrate. The dielectric can also function as an ultraviolet light reflector, helping to improve the efficiency of the plasma display cell.

Figure 8:
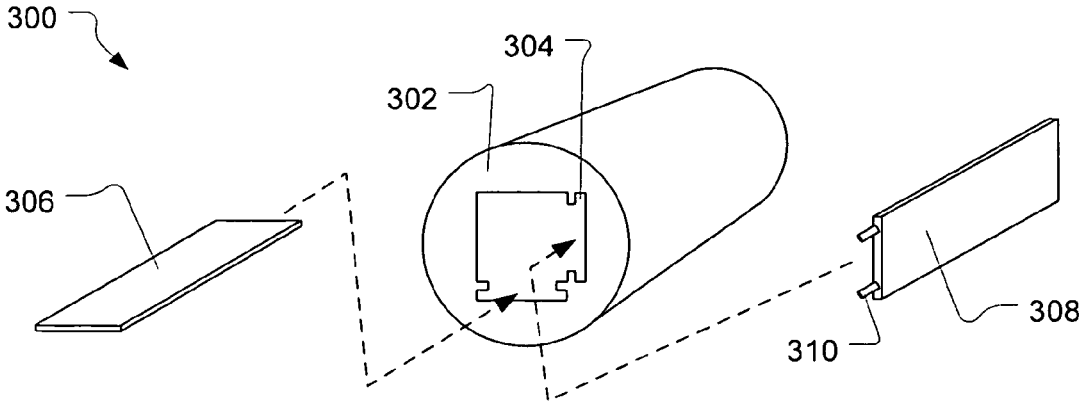
FIG. 8 illustrates an end-on perspective view of another arrangement of a plasma display tube according to an embodiment of the present invention.

FIG. 8 illustrates an end-on perspective view of another arrangement of a plasma display tube 300. The tubular enclosure 302 has a series of internal slots 304 to hold multiple elongate substrates inserted into the tubular enclosure. For example, a first substrate 306 can include phosphor, and a second substrate 308 can include sustain electrodes 310. Electrodes can be disposed within the second substrate or microfabricated on a surface of the second substrate. A dielectric material can be included on the second substrate.

Figure 9:
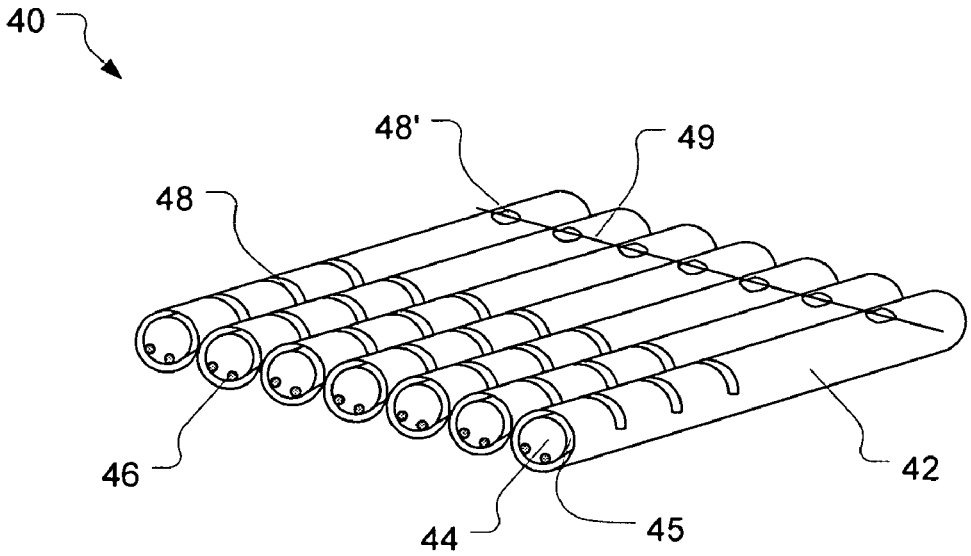
FIG. 9 illustrates a perspective view of a plasma display according to another exemplary embodiment of the present invention.

Plasma display tubes can be formed into a plasma display panel as will now be described. FIG. 9 illustrates a plasma display according to another exemplary embodiment of the present invention. The plasma display 40 consists of a plurality of substantially parallel gas enclosure tubes 42. Disposed within the gas enclosure tubes are a plurality of elongate substrates 44 and a gas (not shown). The elongate substrates have a linear array of plasma cell components 45 microfabricated thereon, for example, as discussed above. The plasma cell components can include a cell separating structure which defines a cell plasma region separated from adjacent cells, for example, as described above. The plasma cell components can also include sustain electrode segments 46 electrically coupled to sustain electrode segments in adjacent cells. For example, the sustain electrodes can be provided by a continuous conductive strip disposed along the side or within a recess of the elongate substrate. The plasma cell components can also include addressing electrode segments 48 or 48' disposed on the outer surface of the gas enclosure tubes. Electrical connection between addressing electrode segments 48 of adjacent gas enclosure tubes can be provided by placing the adjacent addressing electrode segments in electrical contact with each other during fabrication. Alternately, a separate electrical connection 49 (e.g., a wire) can be disposed perpendicular to the gas enclosure tubes so as to provide electrical connection between addressing electrode segments 48'. The addressing and sustain electrodes can provide row-column addressing of individual plasma cells as is known in the art. The sustain electrodes can also be used to maintain an active plasma in the cells once ignited as is known in the art. Display electronics for interfacing to addressing and sustain electrodes of a plasma cell array are known in the art and will not be described further.

Figure 10:
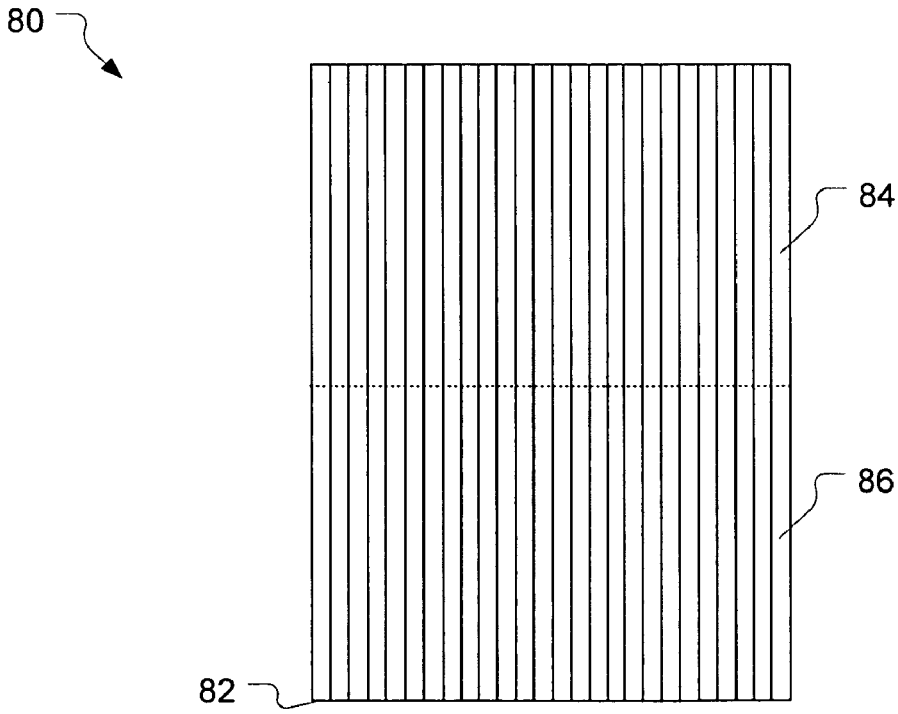
FIG. 10 illustrates a combined display and keyboard unit according to another exemplary embodiment of the present invention.

As yet another embodiment of the present invention, a capacitance touch sensor and a plasma display can be combined in a single unit as will now be described. For example, FIG. 10 illustrates a combined display and keyboard unit 80 constructing using a plurality of multi-cell electronic circuit arrays 82. Each multi-cell electronic circuit array includes in an upper half 84 a plurality of plasma display cells, for example, as discussed above. A lower half 86 of each multi-cell electronic circuit array includes a plurality of capacitors, for example as discussed above. The top half of the combined display and keyboard unit can be configured to function as a plasma display, for example as described above. The bottom half can be configured to function as a two dimensional position sensor, for example as described above. More particularly, particular positions on the bottom half can be labeled to correspond to keys, and touch positions translated into the appropriate characters for input to another device.

Figure 11:
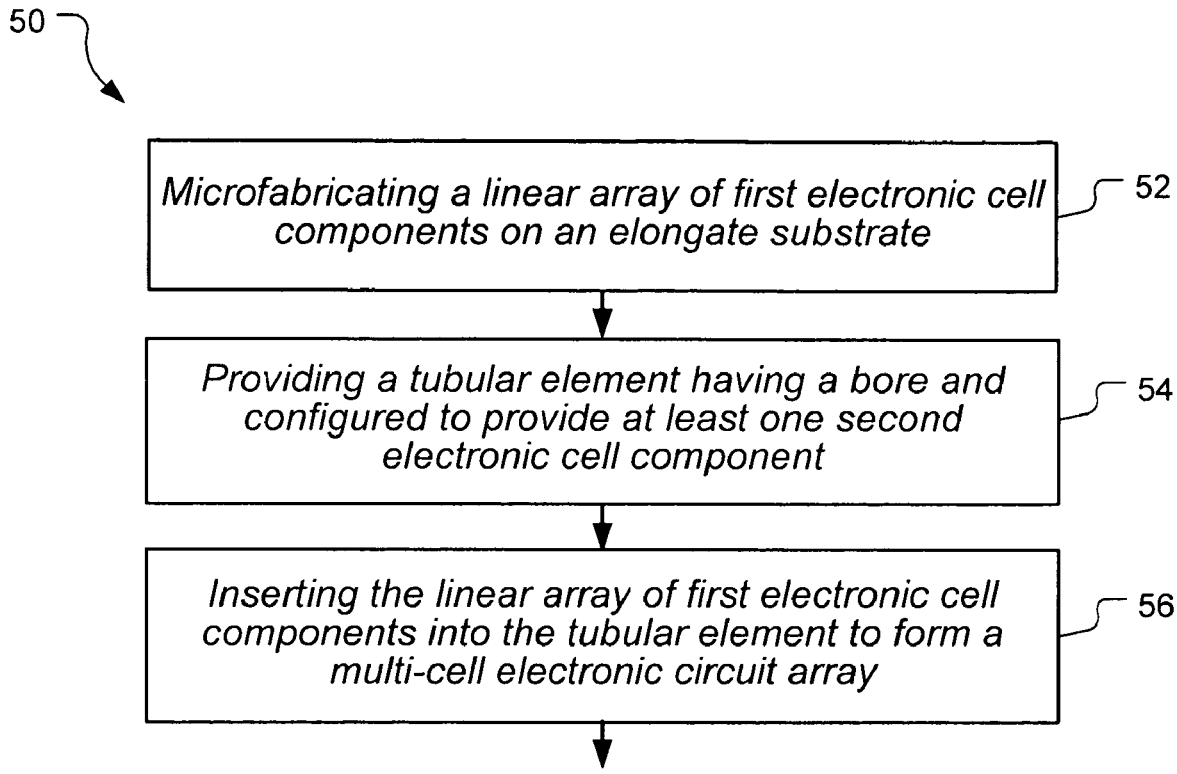
FIG. 11 illustrates a flow chart of a method of manufacturing a multi-cell electronic circuit array in accordance with an embodiment of the present invention.

A method of manufacturing a multi-cell electronic circuit array will now be described, as illustrated in FIG. 11 in accordance with an embodiment of the present invention. The method 50 includes the step of (a) microfabricating 52 a linear array of first electronic cell components on an elongate substrate. For example, the elongate substrate may be a cylindrical structure with a round, oval, or polygonal cross section as described above. Microfabrication of the linear array can be performed using cylindrical lithography, for example, as described in commonly-owned U.S. Pat. Nos. 5,106,455, 5,269,882, and 5,273,622 to Jacobsen et al., herein incorporated by reference.

The method 50 also includes the step of (b) providing 54 a tubular element having a bore and having at least one second electronic cell component. The method may also include microfabricating a linear array of second electronic cell components on the tubular element. For example, microfabrication can be performed as described above to form plasma cell components, electrical interconnects, or the like on or in the tubular element.

The method 50 also includes the step of (c) inserting 56 the linear array of first electronic cell components into the tubular element to form a multi-cell electronic circuit array.

The method 50 may also include evacuating the tubular element to remove gases or other material present within the tube. The tubular element may then be sealed, or filled with a gas or liquid and then sealed.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present: a) "means for" or "step for" is expressly recited in that limitation; b) a corresponding function is expressly recited in that limitation; and c) structure, material or acts that support that function are described within the specification. Accordingly, the scope of the invention should be determined solely by the appended claims and their legal equivalents, rather than by the descriptions and examples given above.

What is claimed is:

1. A multi-cell electronic circuit array comprising:

an elongate substrate having an array of first electronic cell components microfabricated thereon;

a tubular enclosure into which the elongate substrate is inserted to form a plurality of individual cells, wherein at least one of the cells contain at least one second electronic cell component microfabricated on the tubular enclosure that interacts with at least one of the first electronic cell components.

2. The multi-cell electronic circuit array of claim 1 wherein the at least one second electronic cell component has a linear array of second electronic cell components microfabricated thereon.

3. The multi-cell electronic circuit array of claim 1 wherein the at least one second electronic cell component comprises electronic interconnect elements disposed on a surface of the tubular enclosure.

4. The multi-cell electronic circuit array of claim 1 wherein the tubular enclosure is sealed and contains a gas.

5. The multi-cell electronic circuit array of claim 1 wherein the tubular enclosure is sealed and contains a liquid.

6. The multi-cell electronic circuit array of claim 1 wherein the tubular enclosure is substantially evacuated and sealed.

7. The multi-cell electronic circuit array of claim 1 wherein the at least one second electronic cell component comprises electronic circuitry disposed on a surface of the tubular enclosure.

8. The multi-cell electronic circuit array of claim 1 wherein the array of first electronic cell components operates in conjunction with the at least one second electronic cell component to function as a plurality of detector circuits.

9. The multi-cell electronic circuit array of claim 1 wherein the array of first electronic cell components operates in conjunction with the at least one second electronic cell component to function as a plurality of emitter circuits.

10. The multi-cell electronic circuit array of claim 1 wherein the array of first electronic cell components comprises a linear array of first capacitor electrodes; and the at least one second electronic cell component comprises a linear array of second capacitor electrodes, each second capacitor electrode disposed adjacent to a corresponding first capacitor electrode to form a capacitor.

11. The multi-cell electronic circuit array of claim 1 wherein the linear array of first electronic cell components comprises a plurality of first plasma cell portions.

12. The multi-cell electronic circuit array of claim 11 wherein the first plasma cell portion comprises a cell separating structure to define a cell plasma region isolated from adjacent cells.

13. The multi-cell electronic circuit array of claim 11 wherein the first plasma cell portion comprises a primary emission region.

14. The multi-cell electronic circuit array of claim 11 wherein the first plasma cell portion comprises an electrode.

15. The multi-cell electronic circuit array of claim 11 wherein the first plasma cell portion comprises a secondary emission region.

16. The multi-cell electronic circuit array of claim 11 wherein the at least one second electronic cell component comprises a linear array of second plasma cell portions.

17. The multi-cell electronic circuit array of claim 16 wherein the second plasma cell portion comprises a secondary emission region.

18. The multi-cell electronic circuit array of claim 16 wherein the second plasma cell portion comprises an electrode.

19. The multi-cell electronic circuit array of claim 11 wherein the elongate substrate comprises:

a first sustain electrode and a second sustain electrode disposed longitudinally along the substrate;

a plurality of dielectric regions disposed substantially between the first and second sustain electrodes to define a plurality of cells; and a plurality of primary emission regions disposed substantially opposite the dielectric region relative to the first sustain electrode and the second sustain electrode.

20. The multi-cell electronic circuit array of claim 19 wherein the at least one second electronic cell element comprises at least one secondary emission region.

21. The multi-cell electronic circuit array of claim 19 wherein the at least one second electronic cell element comprises a plurality of addressing electrodes, each one of the plurality of addressing electrodes disposed proximate to a corresponding one of the plurality of primary emission regions.

22. A plasma display comprising:

a plurality of substantially parallel gas enclosure tubes;

a plurality of elongate substrates, at least one of the plurality of elongate substrates disposed within each one of the plurality of gas enclosure tubes; and a linear array of plasma cell components disposed on each one of the plurality of elongate substrates, wherein each plasma cell component comprises a cell separating structure to define a cell plasma region separated from adjacent cells.

23. The plasma display of claim 22 wherein the plasma cell comprises a pair of sustain electrode segments electrically coupled to sustain electrode segments in adjacent cells;

a dielectric region disposed substantially between the pair of sustain electrode segments; and a primary emission region disposed adjacent to the dielectric region opposite the pair of sustain electrode segments.

24. The plasma display of claim 22 wherein the plurality of substantially parallel gas enclosure tubes further comprises a plurality of cell phosphor regions disposed on a surface of the gas enclosure tube.

25. The plasma display of claim 22 further comprising a gas disposed within the plurality of substantially parallel gas enclosure tubes and substantially contained within the plurality of cell plasma regions.

26. A method for manufacturing a multi-cell electronic circuit array comprising:

(a) micro fabricating array of first electronic cell components on an elongate substrate;

(b) providing a tubular element having a bore and having at least one second electronic cell component; and (c) inserting the array of first electronic cell components into the tubular element to form a plurality of individual cells, wherein at least one of the cells contains at least one second electronic cell component microfabricated on the tubular element that interacts with at least one of the first electronic cell components.

27. The method of claim 26 wherein step (a) further comprises microfabricating the first electronic cell components by performing cylindrical lithography.

28. The method of claim 26 wherein step (b) further comprises microfabricating a linear array of second electronic cell components on the tubular element.

29. The method of claim 26 further comprising filling the tubular element with a gas.

30. The method of claim 26 further comprising filling the tubular element with a liquid.

31. The method of claim 26 further comprising substantially evacuating the tubular element and sealing the tubular enclosure.

* * * * *